US009340327B2

(12) United States Patent
Misner

(10) Patent No.: US 9,340,327 B2
(45) Date of Patent: May 17, 2016

(54) CASH BAG LOCK

(75) Inventor: Michael O. Misner, Lake Villa, IL (US)

(73) Assignee: THE EASTERN COMPANY, Wheeling, IL (US)

( * ) Notice: Subject to any disclaimer, the term of this patent is extended or adjusted under 35 U.S.C. 154(b) by 529 days.

(21) Appl. No.: 13/573,392

(22) Filed: Sep. 13, 2012

(65) Prior Publication Data

US 2013/0121621 A1 May 16, 2013

Related U.S. Application Data

(63) Continuation-in-part of application No. 29/395,039, filed on Nov. 15, 2011, now Pat. No. Des. 674,794.

(60) Provisional application No. 61/629,221, filed on Nov. 15, 2011.

(51) Int. Cl.

| | |
|---|---|
| ***B65D 33/16*** | (2006.01) |
| ***B65D 33/34*** | (2006.01) |
| ***E05B 17/20*** | (2006.01) |
| ***E05B 37/02*** | (2006.01) |
| ***E05B 65/52*** | (2006.01) |
| ***E05B 39/02*** | (2006.01) |
| ***B65D 33/25*** | (2006.01) |

(52) U.S. Cl.

CPC ..... *B65D 33/16* (2013.01); *B65D 33/2591* (2013.01); *B65D 33/34* (2013.01); *E05B 17/20* (2013.01); *E05B 37/02* (2013.01); *E05B 39/02* (2013.01); *E05B 65/52* (2013.01); *B65D 2255/00* (2013.01); *Y10T 70/7418* (2015.04); *Y10T 70/8297* (2015.04)

(58) Field of Classification Search

CPC A44B 19/301; Y10T 70/5053; Y10T 292/48; Y10T 70/8297; Y10T 70/7418; G09F 311/0305; B65D 33/16; B65D 33/34; B65D 33/2591; B65D 2255/00; E05B 17/20; E05B 37/02; E05B 65/52; E05B 39/02

USPC ..... 383/5, 42; 70/442, 332, 68, 70, 440, 70/439

See application file for complete search history.

(56) References Cited

U.S. PATENT DOCUMENTS

| | | | | | |
|---|---|---|---|---|---|
| 1,950,414 | A | * | 3/1934 | Rifkin | 70/68 |
| 1,950,415 | A | * | 3/1934 | Rifkin | 70/68 |
| 2,188,620 | A | * | 1/1940 | Boenecke | 70/68 |
| 3,138,842 | A | * | 6/1964 | Arthur | 24/615 |
| 3,580,016 | A | * | 5/1971 | Kerr | 70/68 |
| 3,653,236 | A | * | 4/1972 | Kerr | 70/68 |
| 3,759,073 | A | * | 9/1973 | Rifkin | 70/68 |
| 3,785,185 | A | * | 1/1974 | Kerr | 70/68 |
| 3,955,842 | A | * | 5/1976 | Edwards | 292/307 R |
| 4,008,914 | A | * | 2/1977 | Anderson | 292/307 R |
| 4,019,353 | A | * | 4/1977 | Christopher | 70/68 |

(Continued)

*Primary Examiner* — Nathan J Newhouse
*Assistant Examiner* — Peter Helvey
(74) *Attorney, Agent, or Firm* — David A. Burge

(57) ABSTRACT

A combination operated lock for use with a security container that has a zippered closure operated by a pull tab movable between open and closed positions, with the lock being operable, when locked, to retain the pull tab in closed position until the lock is unlocked by setting a combination. The lock preferably has a housing connected to a flexible fabric wall of the security container, and dials that are turned to set a combination for unlocking the lock. In some embodiments, the lock cannot be unlocked unless and until a one-use seal is broken and removed from the housing to which the seal was attachable only after the lock was locked.

21 Claims, 11 Drawing Sheets

(56) References Cited

U.S. PATENT DOCUMENTS

| | | | | | |
|---|---|---|---|---|---|
| 4,031,724 | A | * | 6/1977 | Atkinson | 70/68 |
| 4,062,090 | A | * | 12/1977 | Moolenaars | 24/387 |
| 4,062,207 | A | * | 12/1977 | Bonner | 70/68 |
| 4,106,801 | A | * | 8/1978 | De Lima Castro Neto | 292/307 R |
| 4,112,990 | A | * | 9/1978 | Anderson | 383/97 |
| 4,249,402 | A | * | 2/1981 | Steinbach | 70/68 |
| 4,512,599 | A | * | 4/1985 | De Lima Castro Netto | 292/307 R |
| 4,602,405 | A | * | 7/1986 | Sturman et al. | 24/385 |
| 4,628,713 | A | * | 12/1986 | Cecchi et al. | 70/58 |
| 4,661,990 | A | * | 4/1987 | Rifkin | 383/97 |
| 4,699,408 | A | * | 10/1987 | Kesselman | 292/307 R |
| 4,744,230 | A | * | 5/1988 | Shum | 70/68 |
| 4,821,539 | A | * | 4/1989 | Steinbach | 70/68 |
| 4,883,295 | A | * | 11/1989 | Kesselman | 292/307 R |
| 4,909,471 | A | * | 3/1990 | Rifkin | 248/551 |
| 4,995,656 | A | * | 2/1991 | Akashi | 292/307 R |
| 5,013,162 | A | * | 5/1991 | Williams et al. | 383/97 |
| 5,065,602 | A | * | 11/1991 | Williams et al. | 70/68 |
| 5,081,855 | A | * | 1/1992 | Terada et al. | 70/68 |
| 5,762,386 | A | * | 6/1998 | Fuehrer | 292/307 R |
| 5,820,267 | A | * | 10/1998 | Nobles | 383/97 |
| 6,029,482 | A | * | 2/2000 | Rifkin | 70/68 |
| 6,233,984 | B1 | * | 5/2001 | Blehi, III | 70/34 |
| 6,360,411 | B1 | * | 3/2002 | Bortz | 24/704.2 |
| 6,677,742 | B1 | * | 1/2004 | Voisine et al. | 324/110 |
| 7,118,144 | B2 | * | 10/2006 | Anderson | 292/307 R |
| 7,338,209 | B2 | * | 3/2008 | Winpenny | 383/5 |
| D673,442 | S | * | 1/2013 | Misner | D8/330 |
| D674,794 | S | * | 1/2013 | Misner | D14/331 |
| 8,555,683 | B1 | * | 10/2013 | Rieder | 70/68 |
| 2004/0083782 | A1 | * | 5/2004 | Lantz | 70/423 |

* cited by examiner

CASH BAG LOCK

CROSS-REFERENCES

The present application claims the benefit of the Nov. 15, 2011 filing date of Provisional Application Ser. No. 61/629,221 filed by Michael O. Misner entitled CASH BAG LOCK.

The present application is a continuation-in-part of Design application Ser. No. 29/395,039 filed Nov. 15, 2011 now U.S. Pat. No. D. 674,794 by Michael O. Misner entitled COMBINATION CONTROLLED CASH BAG LOCK.

The disclosures of all of the above-identified applications are incorporated herein by reference, in their entirety.

BACKGROUND

Flexible fabric security pouches, bags and containers having zipper closures that are lockable are often referred to as "cash bags." They are widely used to temporarily retain and transport items such as confidential legal papers, small firearms, and valuables such as coins, currency, checks, jewelry and the like. Security bags, pouches and containers of this type are typically formed of wear, tear and puncture resistant material, and have heavily constructed zippered closures. Key operated locks are customarily provided to hold in closed position the pull tabs that operate the zipper closures.

The use of key-operated locks on such security bags, security pouches and other security containers can present problems. In addition to keeping the containers themselves secure and safe from attack during times of use and non-use, a proper measure of security must also be provided and maintained for the plurality of keys that are provided to operate each differently keyed lock. If keys are lost or compromised, the associated security bags, pouches and containers must be taken out of service to permit their locks to be rekeyed, with the code numbers of the new keys being recorded before the keys and the rekeyed security bags, pouches and containers are redistributed to authorized persons.

To render apparent the possibility that a locked security bag, pouch or container has been intercepted and opened by unauthorized persons seeking access to its contents, it is known to provide security bags, pouches and containers with uniquely numbered or otherwise uniquely identified or configured seals of a one-use type that preferably must be broken and removed to unlock the security containers and gain access to their contents. Because the one-use seals cannot be reused, and because each seal is configured or identified in a unique manner or carries an unpredictable identifier that is intended to be unknown to unauthorized persons, it is believed that these security measures render the unnoticeable replacement of a broken and removed seal extremely difficult, if not impossible.

Hopefully, a broken or missing seal, or the substitution of an improperly identified replacement seal serves to immediately warn the recipients of security bags, pouches or containers that the bag, pouch or container is likely to have been intercepted and opened while in storage or during travel from one location to another, and to warn that the contents may have been accessed by unauthorized persons. Such warnings should always be taken seriously, even if a lock used to hold closed the security bag, pouch or container is still in a properly locked condition.

While it is known in some applications to replace various types of key operated locks and locking mechanisms with combination operated locks and locking mechanisms, no such replacement is known to have taken place in the design of security containers. Direct replacement of keyed locks and key operated locking mechanisms with combination operated locks is often difficult to achieve, if for no other reason than the fact that combination operated locks and locking mechanisms quite frequently require differently sized, differently configured housings and other associated components than are utilized by key operated locks and locking mechanisms.

Such security measures as have been developed over the years for use with key operated locks frequently prove to be inappropriate for use with combination operated locking mechanisms which require their own unique set of security measures. For example, whereas key operated locks need a capability to be rekeyed from time to time, combination operated locks need a capability to have their combinations changed from time to time. Whereas it may have made little difference whether key operated locks were rekeyable when locked or unlocked, combination operated locks must have combinations that can only be reset when the locks are unlocked, and when the associated security containers are open.

As an added measure of security, it is desirable for the combination operated locks of security containers to permit resetting of their combinations only by personnel who are in possession of some a uniquely configured, specialized tool that prepares the particular lock to have its combination altered. Absent the availability of the required uniquely configured and specialized tool, it is desirable for a combination operated lock of a security container to provide a lockout capability that effectively resists alteration of the unlocking combination—but designers of combination operated locks and locking mechanisms have not presented a solution that addresses this need until now.

It is well known to provide combination operated locks of various types that have a capability, mechanism and procedure for their combinations to be changed or reset. Among the many patents that disclose such combination operated locks are some that list the applicant as an inventor, including U.S. Pat. Nos. 8,201,423, 7,832,238, 7,363,782, 7,159,422, 7,007,521 and 6,877,345. A much earlier reference that also discloses a combination operated lock with a changeable combination is U.S. Pat. No. 4,719,776 entitled Combination Lock With Combination-Changing Feature, assigned on its face to Presto Lock, Inc. These seven patents are referred to later herein as the "Changeable Combination Patents," and their disclosures are incorporated herein by reference.

SUMMARY

The present invention relates to a combination operated lock that is well suited for use on flexible fabric security bags, pouches or containers—and to security bags, pouches and containers equipped with combination operated locks.

In some forms, the present invention relates to a flexible walled security container having a zippered closure operated by a pull tab or "slider" that is movable between open and closed positions, and having a combination operated locking mechanism for releasably retaining the pull tab or slider in a closed position until a proper combination is set to permit the pull tab or slider to be moved away from its closed position to provide access to contents of the container.

In some forms, the present invention relates to a combination lock that has a housing connected to a flexible fabric wall of a security container, and dials that can be turned to set a combination for unlocking the lock to permit a pull tab operator of a zippered closure of the container to be moved to open the container.

In some embodiments, a combination operated lock usable with a zipper closure of a flexible fabric security container cannot be unlocked unless and until a one-use seal is broken and removed from a housing of the lock to which the seal was attachable only after the lock was locked.

In some forms, the present invention relates to a combination controlled lock for a security container wherein the lock has a plurality of rotatable dials that are individually rotatable to set elements of a combination that, when set, permits a movable operating element of the lock to be moved to a position releasing a spring-projected lock bolt for movement to an open position that permits a pull tab of a zipper closure to move from a closed position to open the container.

In some forms, the present invention relates to a combination operated lock having a changeable combination that can be blocked from being changed by use of a specially configured tool.

In some forms, the present invention relates to a combination operated lock that cannot be opened, unlocked or released unless and until a one-use seal that is removably attached to, installed on, snapped into engagement with, or releasably retained by a housing of the lock is broken, destroyed, removed only in part, or otherwise rendered non-reusable when, if, as or prior to the lock being opened, unlocked or released.

In some forms, the present invention relates to combination operated locks having at least one mode of operation capable of being blocked from operating or from being used by a one-use seal that is attached to, installed on, snapped into engagement with, or releasably retained by a housing of the lock when, if, as or after the lock is being locked, and which, after being attached to, installed on, snapped into engagement with, or releasably retained by the lock housing must be broken, destroyed, removed in part, or otherwise rendered non-reusable when, if, as or before the lock is opened, released or unlocked.

DESCRIPTION OF THE DRAWINGS

A fuller understanding of the present invention may be had by referring to the description and claims that follow, taken in conjunction with the accompanying drawings, wherein:

DETAILED DESCRIPTION

Figure 1:
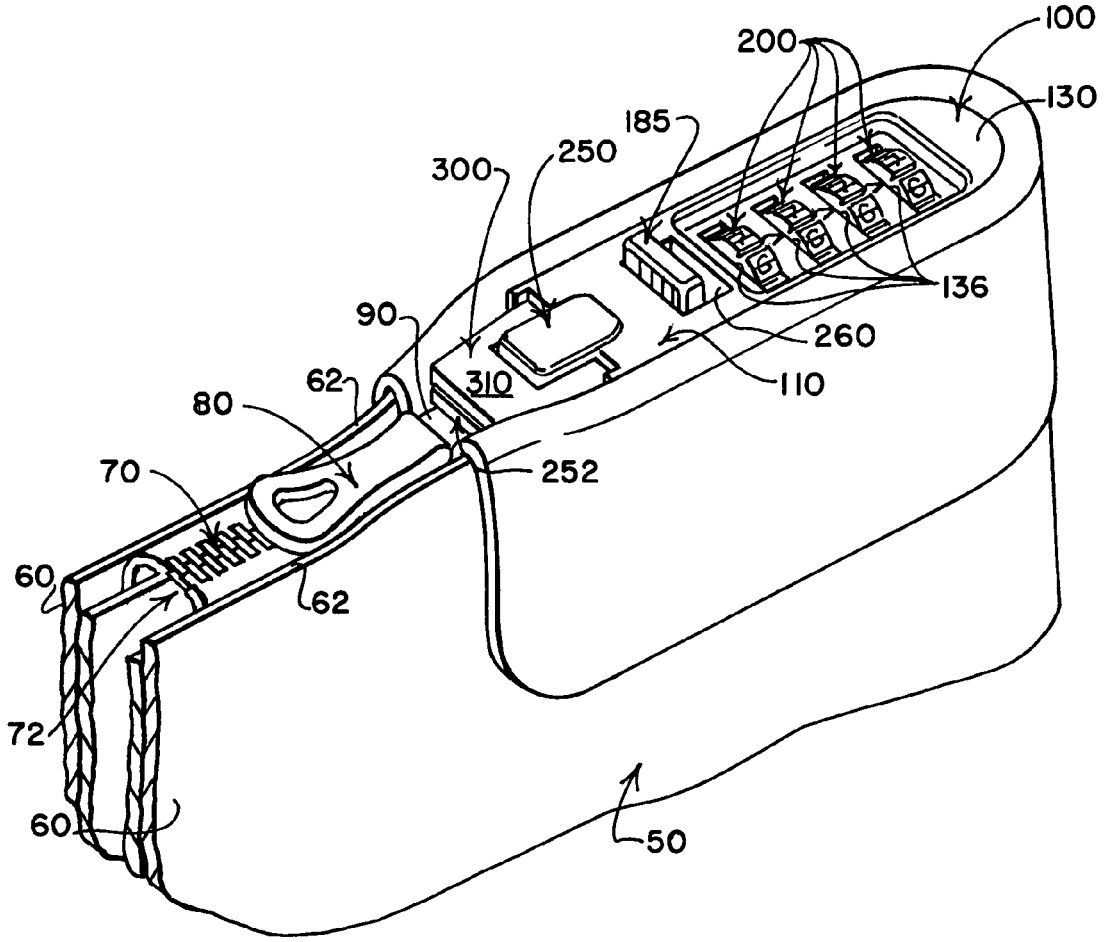
FIG. 1 is perspective view of a portion of a flexible walled security container having a zippered opening along edge portions thereof, to which is attached a combination controlled locking mechanism for releasably retaining an operating tab of the zipper when the locking mechanism is in a locked position as depicted, with the view also showing an optional, generally trapezoidal shaped seal installed on and connected to the housing.
Figure 2:
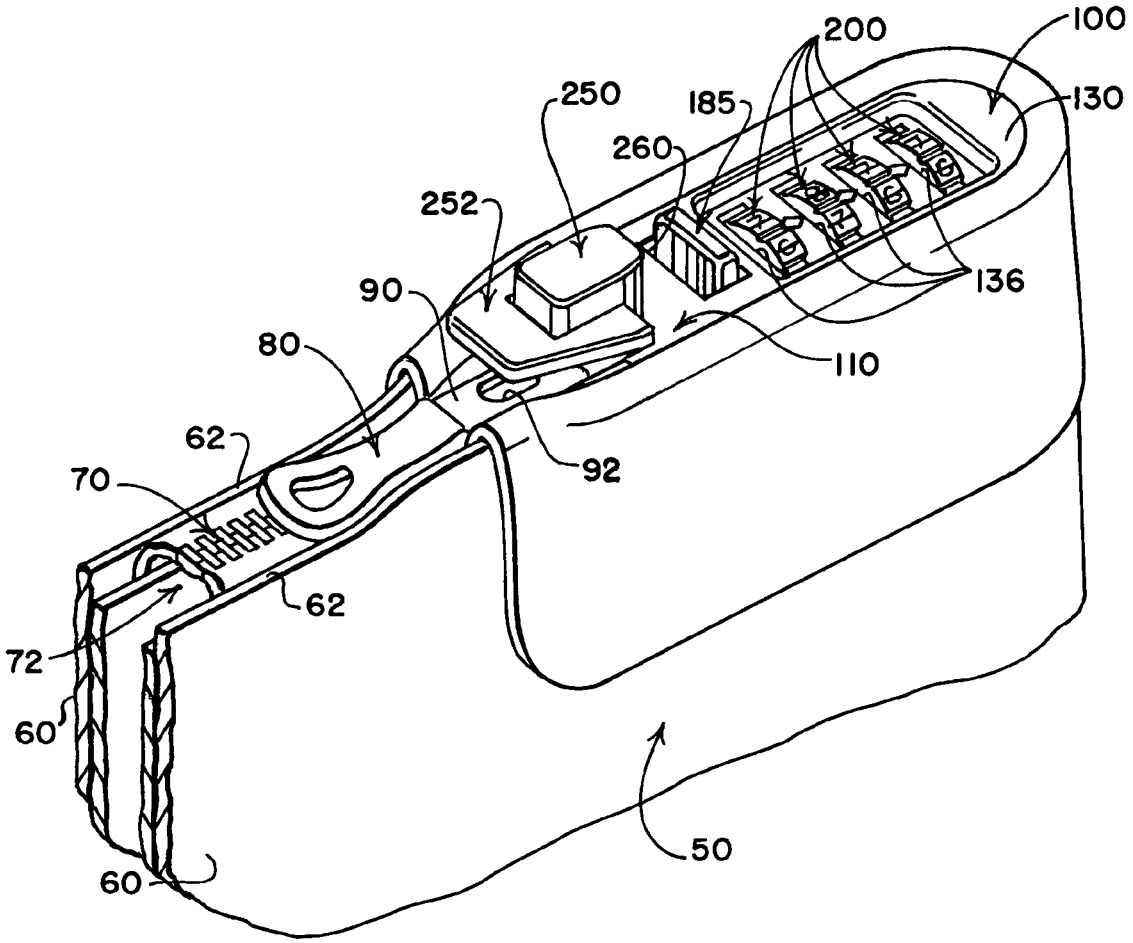
FIG. 2 is a perspective view similar to FIG. 1, with the locking mechanism in an unlocked position, with a spring-projected bolt of the locking mechanism raised to an open, unlocked position which occurs in response to rightward sliding movement of a finger-engageable release member, which sliding movement is enabled once all four of the individually rotatable dials of the locking mechanism have been turned to set elements of a proper combination for unlocking the locking mechanism, with the view depicting the fact that the seal shown in FIG. 1 has been broken and removed, thereby enabling the spring-projected bolt of the locking mechanism to be raised out of the closed, locked position that is shown in FIG. 1 to the open, unlocked position shown in FIG. 2.

Referring to FIGS. 1 and 2, a flexible walled security bag, pouch or container is indicated generally by the numeral 50. The security container 50 has walls 60 that are preferably formed from wear, tear and abrasion resistant flexible fabric in a manner well known to those skilled in the art. Along edge regions 62 of the walls 60, a zipper 70 is provided to give the security container a zipper-closable opening 72. The zipper 70 has an operating element or pull tab 80 that may be pulled or otherwise manually moved along the container's zippered opening 72 to open and close the opening 72.

When the container's zippered opening 72 is open, contents of the container (typically such as confidential documents, small firearms, or other valuables, not shown) may be inserted into, accessed while within, and withdrawn from the container 50. When the container's zippered opening 72 is closed, the container 50 is capable of retaining its contents for storage and transport from one location to another.

Figure 3:
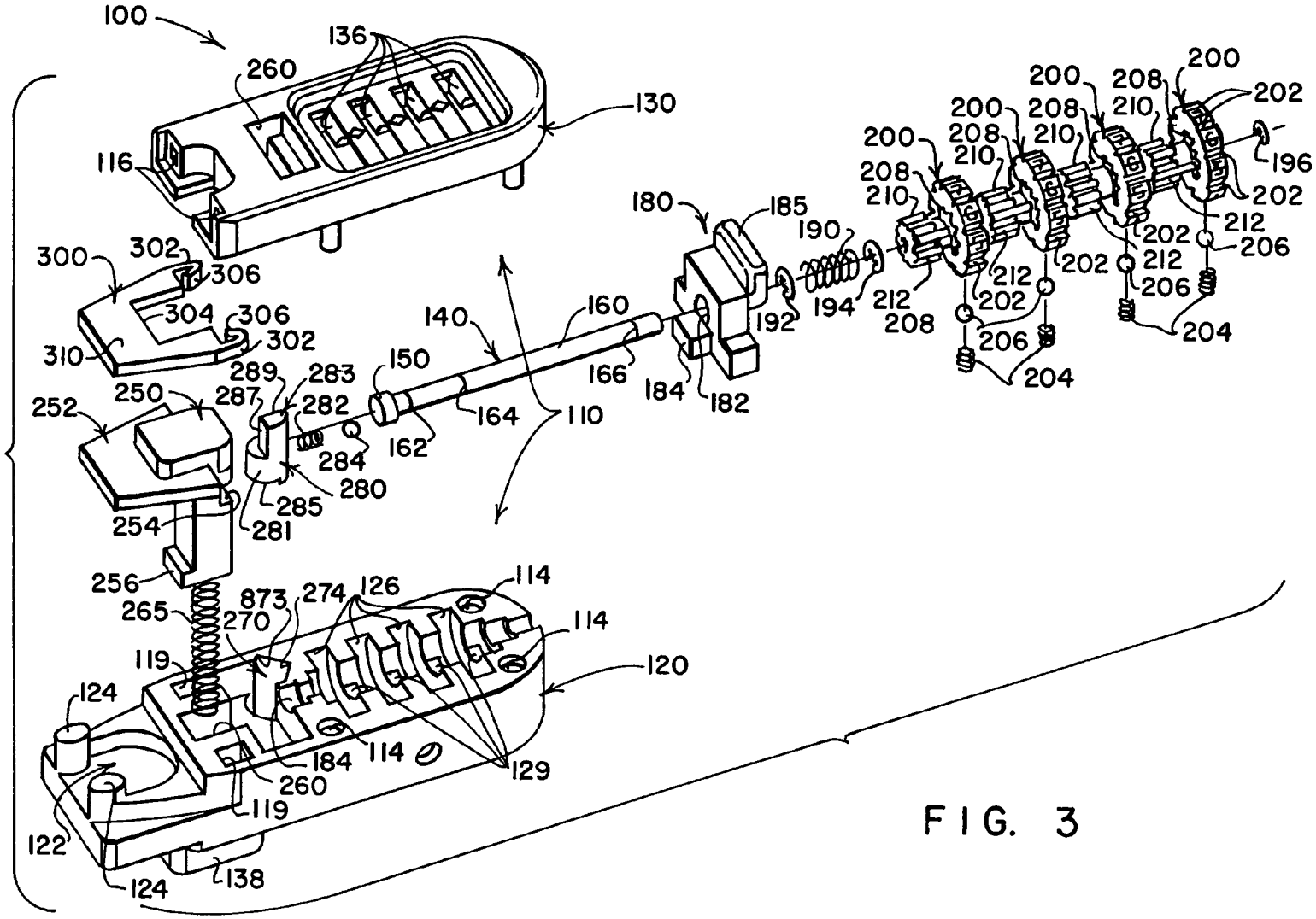
FIG. 3 is an exploded perspective view showing components of the locking mechanism as well as one of the optional, generally trapezoidal-shaped seals that can be connected to a housing of the lock, and also showing elements of a blocking device that may be incorporated into the locking mechanism to selectively permit or prevent a proper combination that unlocks the locking mechanism to be modified or changed.
Figure 4:
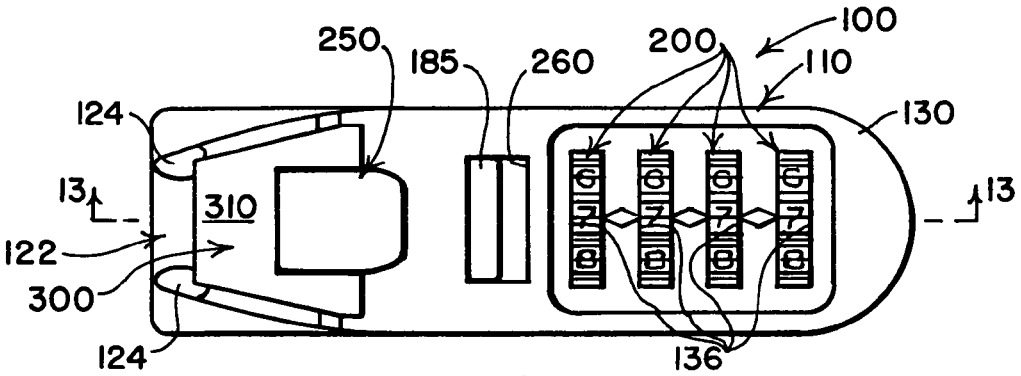
FIG. 4 is a top view of the locking mechanism shown in a locked attitude with one of the optional seals shown connected to the housing of the locking mechanism.
Figure 5:
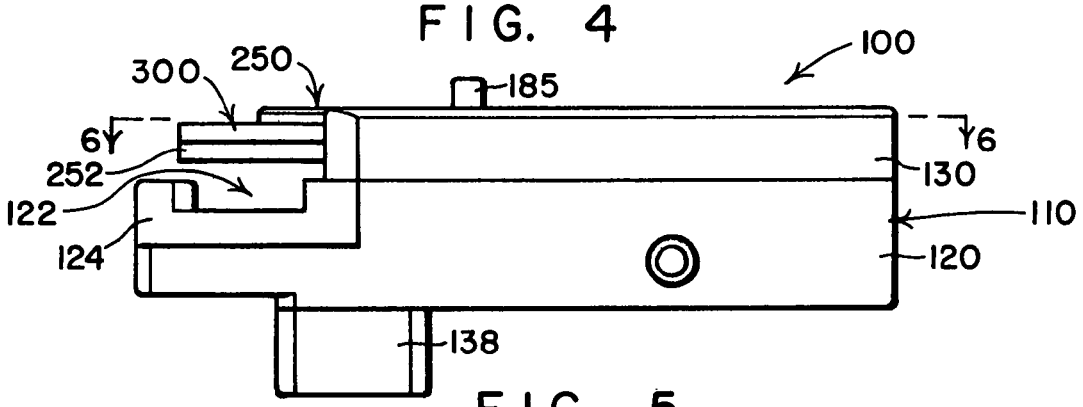
FIG. 5 is a front side view thereof.
Figure 6:
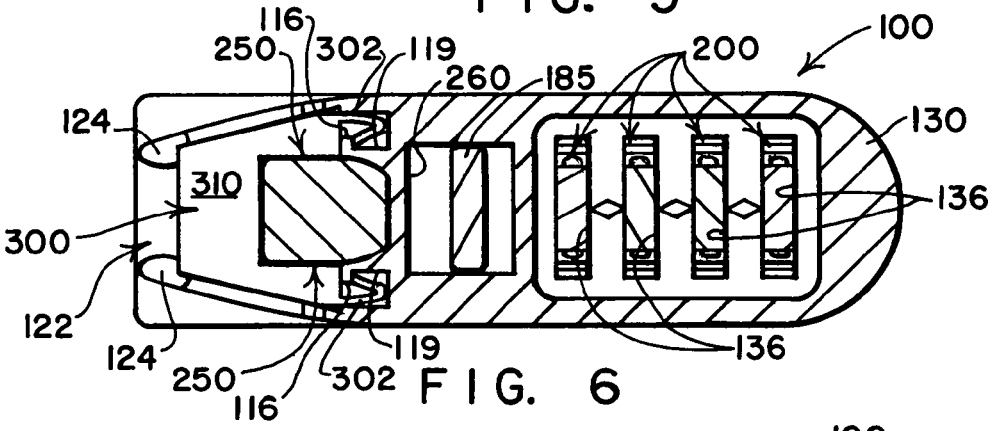
FIG. 6 is a cross-sectional view as seen from a plane indicated by a line 6-6 in FIG. 5, with the view showing how a pair of thin, normally V-shaped leg portions of the optional, generally trapezoidal shaped seal snap into retained engagement with portions of the housing of the locking mechanism after the normally V-shaped leg portions are inserted through small, generally rectangular shaped housing openings which are best shown in FIG. 21.
Figure 7:
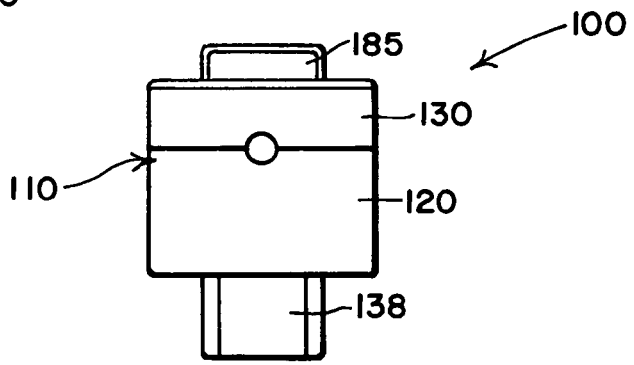
FIG. 7 is a right end view of the locking mechanism in a locked attitude, as the locking mechanism is depicted in FIGS. 4 and 5.

For releasably retaining the zipper tab 80 in a closed position, a locking mechanism 100 is securely connected to the container walls 60 at a location near one end of the container's opening 72. The locking mechanism 100 has a housing 110 comprised mainly by lower and upper portions 120, 130, respectively, as shown in an exploded view provided by FIG. 3. As can be seen in FIG. 3, the lower portion 120 of the housing 110 has a left end region that defines a U-shaped recess 122 which is sized and configured to closely receive and releasably retain a right end region of an extension 90 of the zipper tab 80.

The locking mechanism or lock 100 has a spring-projected lock bolt 250 that is carried by the housing 110 of the lock 100 for movement vertically relative to the housing 110 between the closed, locked position shown in FIG. 1, and the open, unlocked position shown in FIG. 2. The bolt 250 has an upper, leftwardly projecting retention formation 252 designed to closely overlie the zipper tab extension 90 when the lock bolt 250 is moved downwardly to its closed, locked position, as shown in FIG. 1.

When the lock bolt 250 is situated in its downward, closed, locked position shown in FIG. 1, an optional projection (not shown) that preferably depends from a bottom side of the bolt's formation 252 engages a hole 92 that is shown in FIG. 2 as extending through the extension 90 of the zipper tab 80. Such engagement assists in retaining the zipper tab 80 in a position fully closing the container opening 72. However, the provision of such a depending projection is actually unnecessary, for the zipper tab extension 90 cannot move away from the locking mechanism 100 when it is received in the U-shaped recess 122 of the lower portion 120 of the housing 110 and is closely overlaid by the retention formation 252 of the bolt 250 when the bolt 250 is depressed to reside in the closed and locked position shown in FIG. 1.

The lock 100 is combination operated. It has four rotatable dials 200 that carry indicia on their circumferences such as numerals, letters or symbols. By independently turning the dials 200, a sequence of elements of a proper combination may be brought to a visually set position so that, when the proper combination is set, the locking mechanism 100 is unlocked. Bringing the locking mechanism 100 to an unlocked attitude enables a finger-engageable button 185 of a release member 180 (FIG. 3) to be slided manually rightwardly from the retaining position of FIG. 1 to the release position of FIG. 2, thereby enabling the spring-projected bolt 250 of the lock 100 to snap up from the closed and locked position of FIG. 1 to the open and unlocked position of FIG. 2.

FIG. 1 shows how the extension 90 of the zipper tab 80 is received in and gripped by the locking mechanism 100 to retain the tab 80 in a closed, locked position when the spring-projected bolt 250 is depressed to its closed, locked position. FIG. 2 shows how the bolt 250 of the locking mechanism 100, when moved upwardly to its open, unlocked position, provides access to and releases the zipper tab 80 so the zipper tab 80 can be grasped and pulled or otherwise manually moved away from the locking mechanism 100 to open the opening 72 of the security container 50.

The spring-projected bolt 250 is retained in the downward, closed and locked position shown in FIG. 1 until two actions are executed. The first action requires that a proper combination be set using the dials 200, to unlock the locking mechanism 100. The second action requires that the upstanding button 185 of the complexly configured release member 180 (see FIG. 3) be manually moved rightwardly to the position shown in FIGS. 2, 8 and 9, which withdraws a leftwardly extending foot portion 184 (FIGS. 3, 9 and 13) of the release member 180 from a rightwardly facing notch 254 (FIGS. 3, 9 and 13) of the spring-projected bolt 250, so the bolt 250 can immediately snap upwardly from the closed and locked position shown in FIG. 1, to the open and unlocked position shown in FIG. 2.

Figure 35:
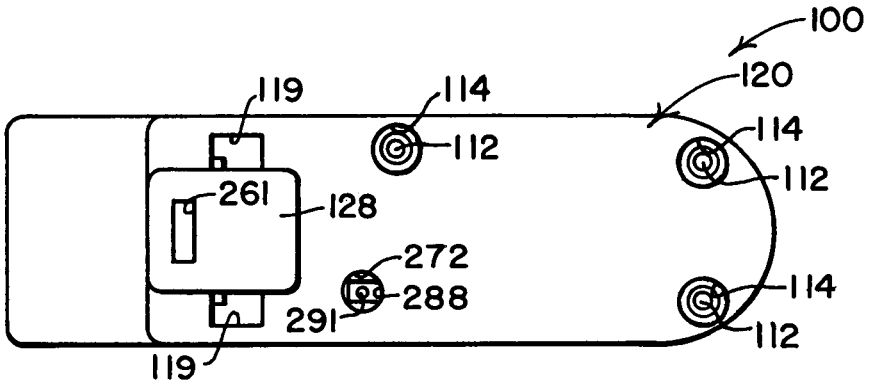
FIG. 35 is a bottom view of the entire locking mechanism assembly, showing three fasteners that clamp the lower and upper housing components in assembly, and showing an opening in the bottom wall of the lower housing component for receiving a rectangular tip of the specially configured tool shown in FIGS. 32 and 33.

The lower and upper portions 120, 130 are held together to form the housing 110 by suitable fasteners 112 having tool-engageable heads that are best shown in the bottom view of FIG. 35. The fasteners 112 can only be accessed from beneath the locking mechanism 100 (i.e., from within the confines of the security container 50) when the locking mechanism 100 is securely connected to the security container 50. The fasteners 112 extend into holes 114 that are provided in the lower housing portion 120, as can best be seen in FIG. 35.

A sturdy left end region of the lower housing component 120 defines the U-shaped, upwardly opening recess 122 that receives the right end region of the zipper extension 90. A pair of upstanding lugs 124 at the open left end of the recess 122 assist in retaining the right end region of the zipper extension 90 within the recess 122 until the spring-projected bolt 250 snaps upwardly, away from its closed and locked position shown in FIG. 1.

Referring again to the exploded view of FIG. 3, the lower and upper components 120, 130 of the housing 110 are of elongate configuration, and cooperate to provide the housing 110 with a hollow interior configured to journal and support an elongate dial shaft 140 for rotational and translational movement relative to the housing 110. The dial shaft 140 has a relatively large diameter head formation 150 near one end, from which extends a relatively smaller, substantially uniform diameter body 160. The body 160 of the dial shaft 140 extends rightwardly through the interior of the housing 110, and defines three circumferentially extending grooves 162, 164, 166 at locations spaced along its length.

Figure 9:
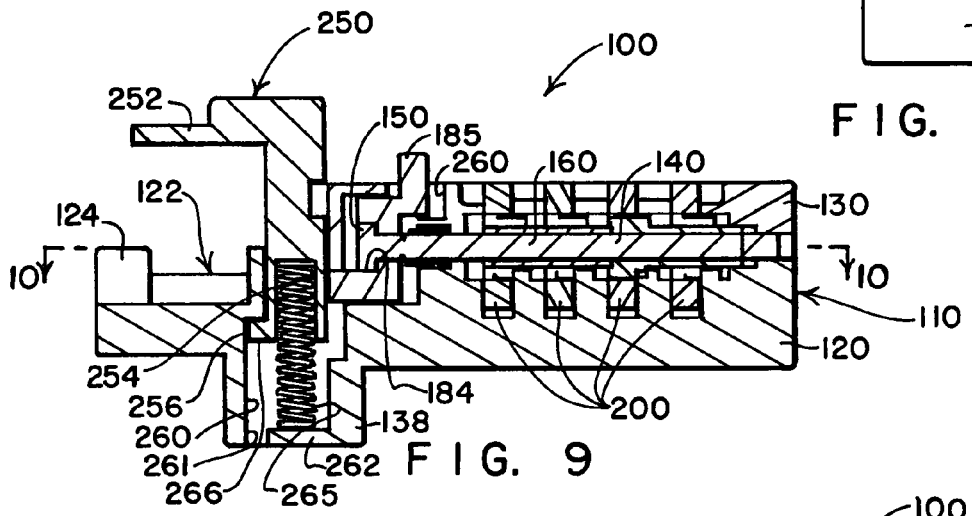
FIG. 9 is a cross-sectional view as seen from a plane indicated by a line 9-9 in FIG. 8, with the spring-projected bolt raised to its open, unlocked position after the finger-engageable release member has been moved rightwardly to release its engagement with a notch in the spring-projected bolt.
Figure 13:
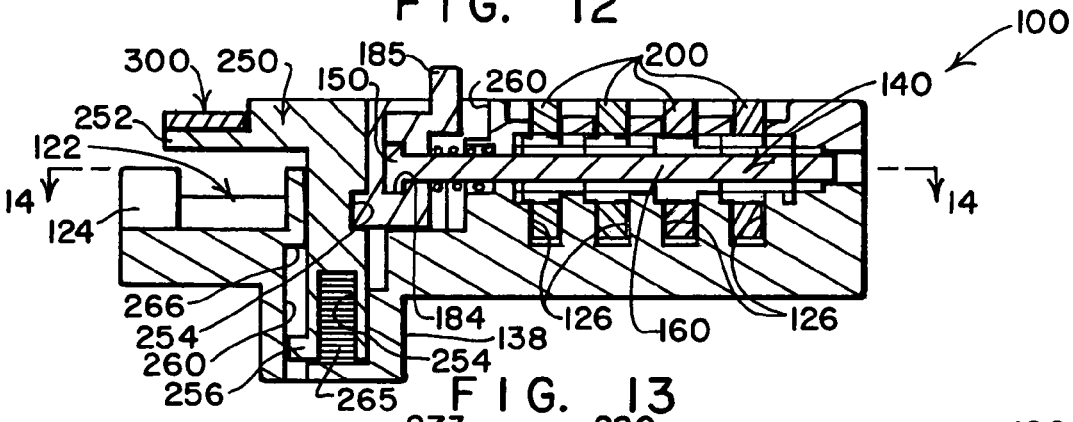
FIG. 13 is a cross-sectional view of the locked locking mechanism and the optional seal, as seen from a plane indicated by a line 13-13 in FIG. 4.

Referring both to the exploded view of FIG. 3 and the assembled cross-sectional views of FIGS. 9 and 13, the dial shaft 140 also extends centrally through the complexly configured release member 180, through three clips 192, 194, 196, through a release lever coil spring 190, through the four combination dials 200, and through four inner wheels 210. And, as can be seen in the cross-sectional views of FIGS. 9 and 13, the relatively large head formation 150 of the dial shaft 140 is received in a relatively large diameter end region of a stepped passageway 182 (best seen in FIG. 3) of the complexly configured release member 180.

Figure 15:
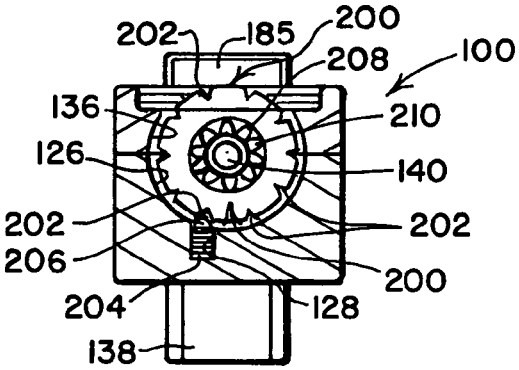
FIGS. 15 and 16 are cross-sectional views of the locked locking mechanism, as seen from planes indicated by lines 15-15 and 16-16, respectively, in FIG. 12.

The dials 200 are identical, and each have small grooves 202 provided between each adjacent pair of numerals, as shown in FIG. 3 (and as are more easily viewed in the cross-sectional view of FIG. 15). The lower component 120 of the housing 110 is provided with four curved passages 126 (FIGS. 3, 15 and 34) that receive the dials 200. Four mating passages 136, best seen in FIGS. 3 and 15, are also provided in the upper component 130 of the housing 110, to receive upper portions of the dials 200.

As can be seen in FIG. 3 and in the sectional view of FIG. 15, the small grooves 202 are provided at regular intervals along the circumferences of the dials 200 are located between each adjacent pair of the numerals (or other identifiers) that are carried on the circumferential surfaces of the dials 200. These grooves 202 are used to releasably detent the dials 200 at rotational positions where the exposed upper surfaces of the dials 200 properly display a numeral (or other identifier) centered along the lengths of the upwardly opening passages 136.

To effect this detenting of the dials, identical compression coil springs 204 and identical ball detents 206 (both shown in FIG. 3) are carried in holes 128 (best seen in FIG. 34) formed in the lower housing component 120. The holes 128 open upwardly into the curved passages 126 of the lower component 120 of the housing 120. As is depicted in FIG. 15, the springs 204 press the ball detents 206 upwardly into engagement with the circumferences of the dials 200. The ball detents 206 are received in the small grooves 202 when the dials 200 are turned to display one of the circumference-carried numerals of the dials 200 at positions centered along the lengths of the passages 136 in which the dials 200 may be manually turned to set a combination.

As can be seen in FIG. 3, the dials 200 are provided with interior teeth 208 that normally engage exterior teeth 212 formed on the inner wheels 210. While the rotatable dials 200 cannot move relative to the housing 110 along the axis of the dial shaft (because the dials are confined to the curved slots 126, 136 of the housing components 120, 130, respectively), the inner wheels 210 are not so confined. In fact, as will be explained, movement of the inner wheels 210 relative to the dials 200 (along the axis of the dial shaft 140) is essential not only to an unlocking of the locking mechanism 100, but also to any modification of the combination.

Figure 16:
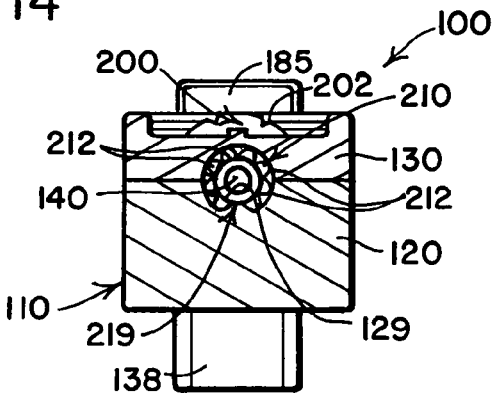

It is important to understand that the exterior teeth 212 that are provided on the circumference of the relatively small inner wheels 210 do not fully populate the circumferences of any of the identical inner wheels 210. As is depicted for one of the identical inner wheels in the sectional view of FIG. 16, all positions about the circumference of each of the inner wheels 210 that can be occupied by the teeth 212 are filled by the teeth 212, except that one such position remains vacant, as is indicated in FIG. 16 by the numeral 219. Stated in another way, each of the inner wheels 210 has a toothless area (such as is indicated by the numerals 219 in FIG. 16).

It is important also to understand that the lower housing member 120 is provided with a small flat surfaces 129 deep inside the lower housing member 120, at locations just to the right of the bottoms of each of the curved grooves 126 in which the dials 200 rotate. When the inner wheels 210 are turned by the dials 200 so that all of the toothless areas 219 align with all of the flat surfaces 129, the inner wheels 210 can move rightwardly together with the dial shaft 140 and the complexly configured release member 180. This rightward movement takes place in response to the upstanding button-like formation 185 of the release member 180 being manually pushed rightwardly.

Figure 8:
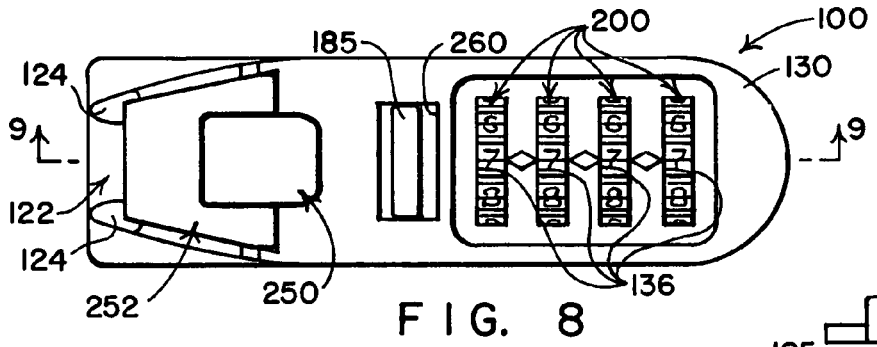
FIG. 8 is a top view of the locking mechanism in an unlocked attitude, with no seal being present to obstruct raising of the spring-projected bolt from a closed, locked position as shown in FIGS. 1, 4, 5 and 7 to an open, unlocked position as shown in FIGS. 2, 8, 9 and 11, and with the view also showing the finger-engageable release member after being slided rightwardly to release the spring-projected bolt for upward, unlocking movement.
Figure 11:
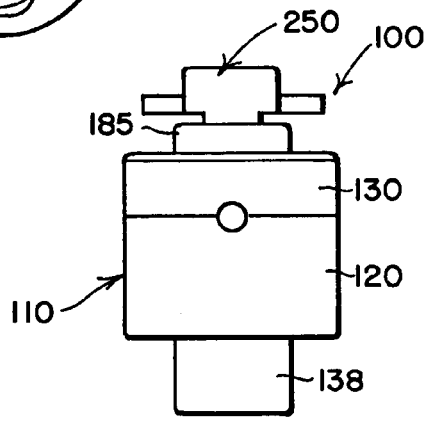
FIG. 11 is a right end view of the unlocked locking mechanism as depicted in FIG. 8.

This rightward movement is only permitted when a proper combination is set by turning the dials 200 to turn the inner wheels 210 to align their toothless areas 219 with the flat surfaces 129. When a proper combination is set, the upstanding button-like formation 185 of the release member 180 can be moved rightwardly to the position that is shown in FIGS. 8 and 9, which releases the spring-projected bolt 250 to snap upwardly to its open position. But, if one looks carefully at FIG. 8, the rightward movement of the upstanding button-like formation 185 needed to release the bolt 250 to snap upwardly is not a full rightward movement of the formation 185 that is permitted by the housing opening 260. This less than full rightward movement enables the spring-projected bolt 250 to snap upwards, as described, but is not a sufficient rightward movement as to disengage the exterior teeth 212 of the inner wheels 210 from the interior teeth 208 of the dials 200.

Figure 36:
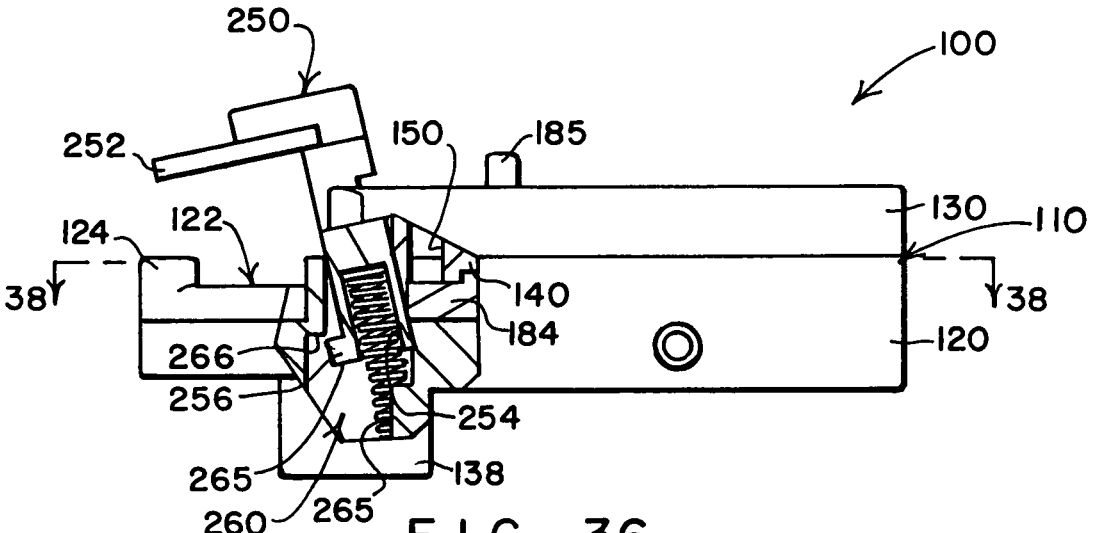
FIG. 36 is a front view of the unlocked locking mechanism, with portions thereof broken away to show how the spring-projected bolt thereof may be tipped to move a portion rightwardly (relative to the housing of the locking mechanism) to a combination-change-enablement position which also causes rightward movement of the dial shaft, the release member, and the inner wheels carried by the dial shaft.
Figure 37:
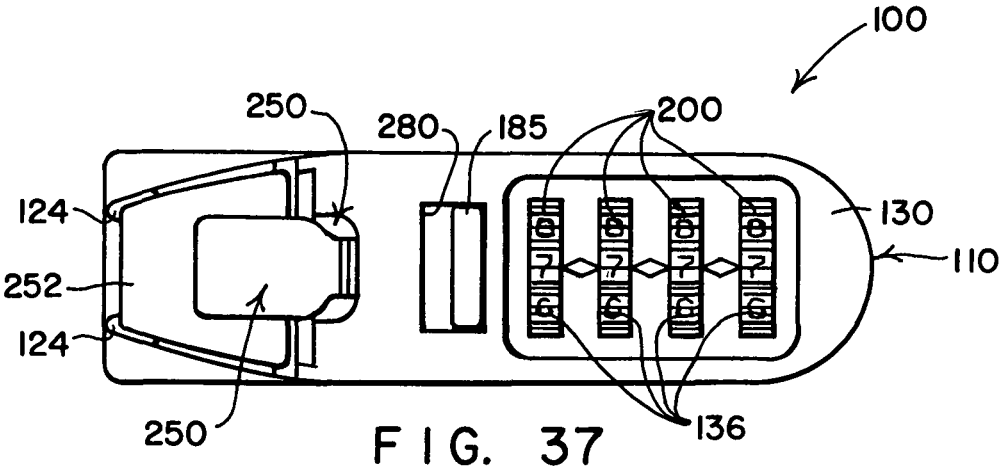
FIG. 37 is a top view of the locking mechanism with components thereof positioned as shown in FIG. 36; and, FIG. 38 is a cross-sectional view, as seen from a plane indicated by a line 38-38 in FIG. 36, with this view being very much like the cross-sectional view of FIG. 10 except that, in FIG. 10, the lockout member is in a combination-reset-prevention position, whereas, in FIG. 38, the lockout member has been turned to a position that enables modification of the combination that unlocks the locking mechanism, AND the dial shaft and the inner wheels have been moved rightwardly (from the unlocked positions shown in FIG. 10) to positions assumed by these components that permit modification of the combination that unlocks the locking mechanism.

Indeed, further rightward movement of the upstanding button-like formation 185 to the position shown in FIG. 37 only occurs when a deliberate attempt is made to modify the existing combination, or to set a new combination to unlock the locking mechanism 100. Such a full rightward movement of the upstanding button-like formation 185 preferably takes place by tipping or tilting the unlocked spring-projected bolt 250 in the manner shown best in FIG. 36. Tipping or tilting the spring-projected bolt 250 in the manner shown in FIGS. 36 and 37 causes a surface of the bolt 250 to press rightwardly against the leftwardly extending foot formation 184 of the release member 180. Rightward pressure on the release member 180 causes the release member 180, the dial shaft 140, and the inner wheels 210 carried by the dial shaft 140 to move rightwardly in unison—it being noted that the inner wheels 210 already have their toothless areas 219 aligned with the flat surfaces 129 because the locking mechanism 100 is already unlocked.

When the combination of the locking mechanism 100 is being changed, the full rightward movement of the inner wheels 210 that takes place (as just described) has the effect of disengaging the driving engagement of the exterior teeth 212 of the inner wheels 210 and the interi- or teeth 208 of the dials 200. The inner wheels 210 are prevented from rotating (because their toothless areas 219 are engaged with the flat surfaces 129), but the dials 200 are free to rotate and, in fact, are manually rotated by the operator of the locking mechanism 100 in order to set a modified combination or entirely new combination to be used forthwith to unlock the locking mechanism 100.

When the dials 200 have been rotated to positions that display the desired modified or new combination, the pressure that is applied during a combination change procedure to the spring-projected bolt 250 to tip or tilt the spring-projected bolt 250 may be released, permitting the bolt 250 to return to the unlocked position shown in FIGS. 8 and 9. Returning the bolt 250 to the unlocked position lets the dial shaft 140 and the inner wheels 210 return to their unlocked positions shown in FIGS. 8-10, which re-engages the driving connection between the exterior teeth 212 of the inner wheels 210 and the inner teeth 208 of the dials 200, and normal operation of the locking mechanism 100 is thereby restored, but with the locking mechanism 100 being responsive to the newly set combination.

If a wrong combination is set by turning the dials, the inner wheels 210 cannot be moved axially relative to the dials 200, and it is impossible to unlock the locking mechanism 100 (because the toothless areas 219 do not align with the flat surfaces 129, hence the upstanding button-like formation 185 cannot be moved rightwardly from the locked position of FIG. 1 to the unlocked position of FIG. 2). But, if a correct combination is set, then the inner wheels 210 can be moved axially relative to the dials just enough to permit such rightward movement of the release member 180 as is needed to release the leftwardly extending foot formation 184 of the release member 180 from the notch 254 of the spring-projected bolt 250, so the bolt 250 can snap upwardly to the open, unlocked position of FIG. 2.

Returning to a description of other details of the locking mechanism 100, and referring primarily to FIG. 9, the lower component 120 of the housing 110 has a depending formation 138 that extends downwardly to provide structure that encloses the vertical passage 260 in which the bolt 250 moves. A compression spring 265 that biases the bolt 250 upwardly has a lower end region that presses against a bottom portion 262 of the depending formation 138. The bottom portion 262 largely, but not entirely, closes the bottom of the vertical passage 260. As can be seen in the sectional views provided by FIGS. 9 and 13, and in the bottom view of FIG. 35, a small opening 261 is provided in the portion 262 of the lower housing component 120. The opening 261 is not functional, but is useful for ease of manufacture of the lower housing component 120.

As is best seen in FIG. 9, the compression coil spring 265 extends upwardly within the passage 260. The spring 265 has an upper end region situated within a smaller passage 254 in the lower end region of the bolt 250. When released to snap upwardly in the passage 260, the spring-projected bolt 250 is caused to stop its upward movement when a leftwardly extending foot 256 (FIGS. 3, 9 and 13) of the bolt 250 engages a rightwardly extending shoulder 266 of the lower housing component 120.

Figure 34:
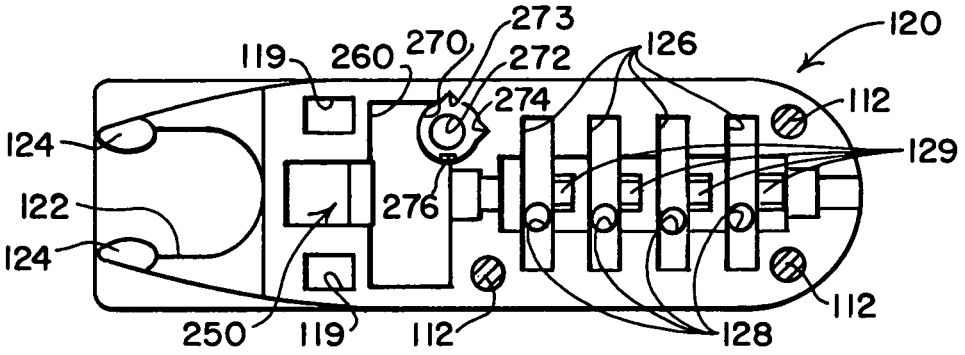
FIG. 34 is a top view of only the lower component of the housing of the locking mechanism, showing details of four holes that receive coil springs and detent balls that engage the rotatable dials of the locking mechanism at each of ten positions wherein the dials display numbers through slots in the upper component of the housing, and showing details of a passage that carries the turnable lockout member shown in FIGS. 27-31.

Referring again to the exploded view of FIG. 3, the lower component 120 of the housing 110 provides a small, off-center, vertically extending passage 270 that opens into the larger vertically extending passage 260. The off-center, vertically extending passage 270 opens downwardly through the bottom of the lower housing component 120 by means of a small hole 272, shown in the top view of FIG. 34, and in the bottom view of FIG. 35. Referring to FIG. 34, the passage 270 has two spaced, vertically extending, right-angle formations 273, 274. At its bottom, the passage 270 has a small projection 276 extending radially inwardly.

Referring to FIG. 3 and to FIGS. 27-31, the locking mechanism 100 optionally may be provided with a generally round lockout member 280 that can reside within the off-center passage 270, together with a small coil spring 282 and a ball detent 284. The spring 282 and ball detent 284 are carried in a closed-ended opening 286 of the lockout member 280, shown best by solid lines in FIGS. 28 and 30, and by hidden lines in FIGS. 27 and 29. The spring 282 presses the ball detent 284 outwardly relative to the opening 286.

Figure 31:
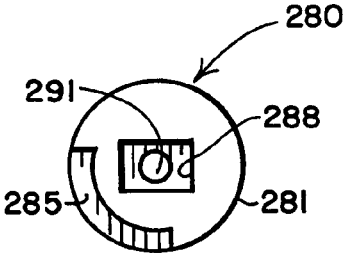
FIG. 31 is a bottom view thereof, showing a curved groove that is provided on approximately one fourth of the circumference of a bottom portion of the lockout member, and a generally rectangular opening with centerpin obstruction, which is typical of various types of oddly configured security openings that may be provided in a centrally located bottom area of the lockout member for being engaged by a specially configured tool that can turn the lockout member approximately a quarter turn between positions that permit and prevent the proper combination for unlocking the locking mechanism to be modified.

Referring to FIGS. 27-31, the lockout member 280 has a generally round, vertically extending outer wall 281, with a right-angle formation 283 defined by its upper part, and a curved groove 285 defined in its bottom surface (shown best in the bottom view of FIG. 31). When the lockout member 280 is in the off-center passage 270, the curved groove 285 in the bottom wall of the lockout member 280 cooperates with the small projection 276 of the lower housing component 120 to limit the range of motion through which the lockout member 280 can be turned within the passage 270 to approximately a quarter-turn, between positions where the ball detent 284 is received either in the right-angle formation 273, or the right-angle formation 274 of the off-center passage 270. The effect of positioning the lockout member 280 in one or the other of these detented positions is to selectively permit or prevent the combination of the locking mechanism 100 to be changed, as will be explained shortly.

Referring to FIG. 31, a generally rectangular tool-receiving opening 288 is provided centrally in the bottom of the lockout member 280. The tool-receiving opening 288 can also be seen in FIG. 35, where it is visible through the small hole 272 provided in a bottom surface of the lower housing component 120. A security pin 291 depends centrally into the generally rectangular tool-receiving opening 288.

Figure 32:
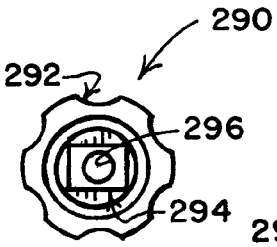
FIG. 32 is an end view of a small, specially configured tool that has a left end region engageable with the generally rectangular, centerpin-obstructed bottom opening of the lockout member.
Figure 33:
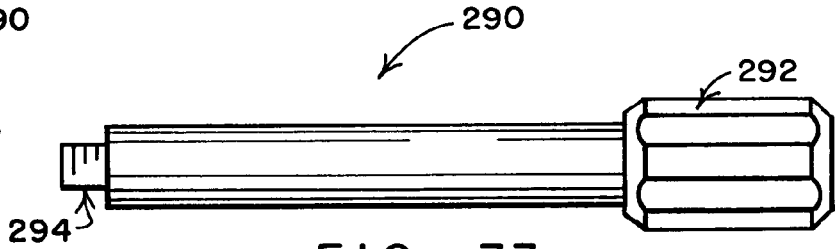
FIG. 33 is a side view of the specially configured tool of FIG. 32.

A specially configured tool 290 is shown in FIGS. 32 and 33. The tool 290 is elongate, having a round body with a fluted knob 292 provided on one end region thereof, and with a generally rectangular formation 294 provided on the opposite end thereof. A central opening 296 is provided in the rectangular formation 294 to receive the security pin 291 when the round body of the tool 290 is inserted through the small hole 272 to extend the rectangular formation 294 of the tool 290 into the rectangular tool-receiving opening 288 of the lockout member 280. By grasping the fluted knob 292 and turning the inserted tool 290, the lockout member 280 may be turned approximately a quarter turn between positions where, as previously described, the ball detent 286 is received in the right-angle formation 273 or in the right-angle formation 274 of the off-center passage 270 to either permit or prevent the unlocking combination of the locking mechanism 100 to be changed.

Figure 10:
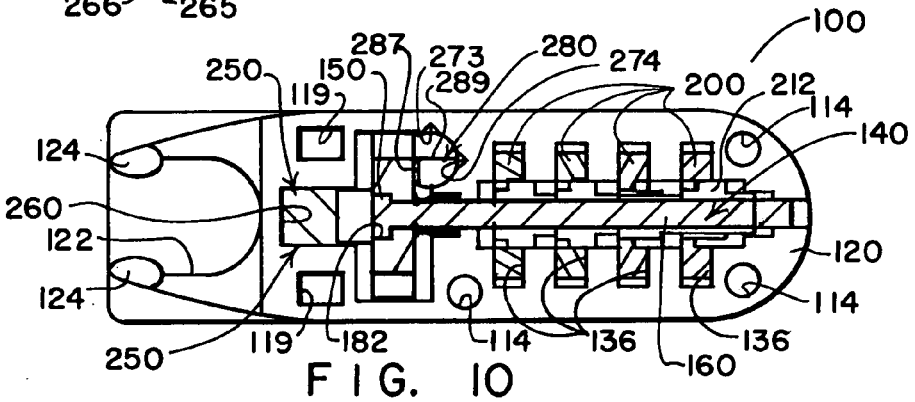
FIG. 10 is a cross-sectional view thereof as seen from a plane indicated by a line 10-10 in FIG. 9.
Figure 12:
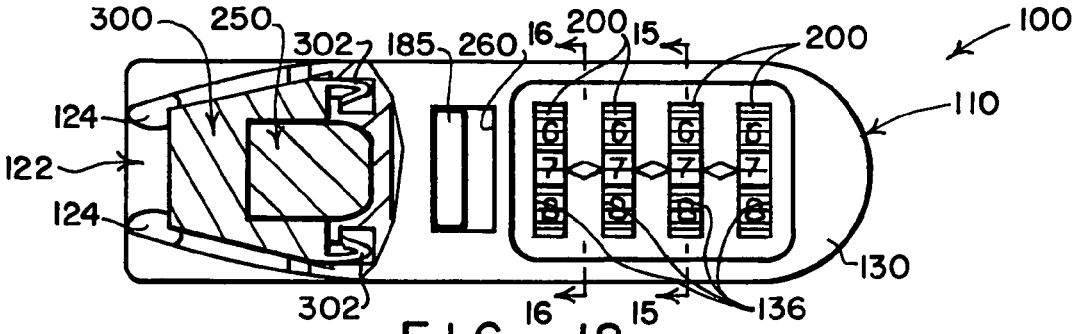
FIG. 12 is a top view similar to FIG. 8 of the locked locking mechanism, with portions of the locking mechanism and of the optional seal broken away and shown in cross-section.
Figure 14:
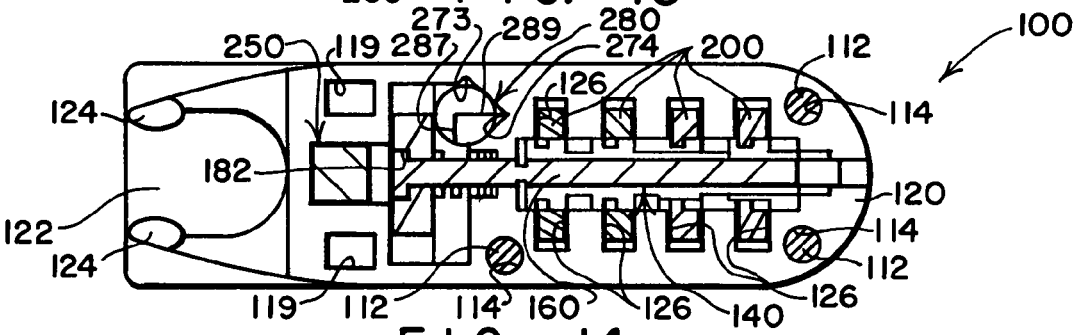
FIG. 14 is a cross-sectional view of the locked locking mechanism as seen from a plane indicated by a line 14-14 in FIG. 13.

Continuing to refer to FIGS. 27-31, the right-angle formation 283 has two flat surfaces 287, 289. One of the detented orientations of the lockout member 280 (which occurs when the ball detent 284 is received in one or the other of the right-angle formations 273, 274) is shown in FIGS. 10 and 14. In FIG. 14, it can be seen that the flat surface 287 of the lockout member 270 faces leftwardly toward, but spaced by a small distance from, a surface of the release member 180. The small distance by which the flat surface 287 is spaced from the release member 180 permits rightward unlocking movement of the release member 180 to the position shown in FIG. 10, but prevents sufficient rightward movement of the release member 180 for the combination of the locking mechanism 100 to be modified or completely changed.

Figure 38:
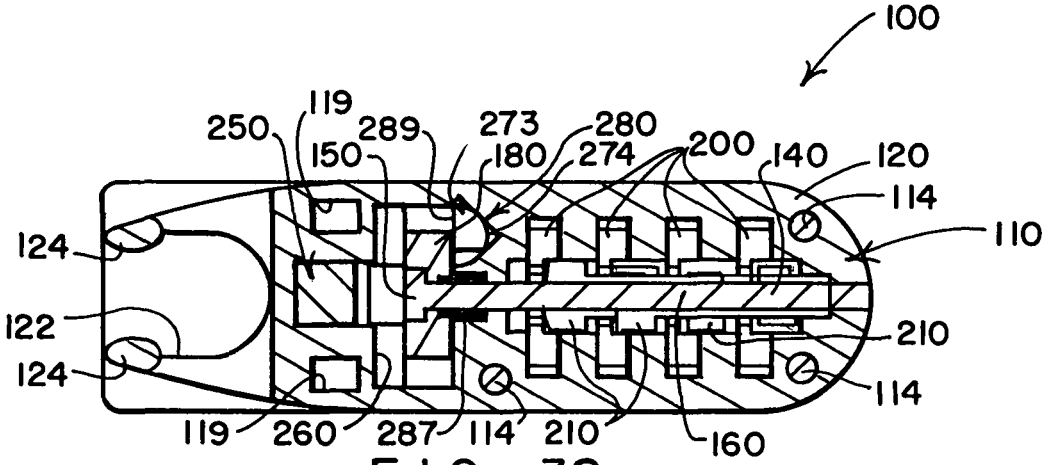

The other of these orientations is shown in FIG. 38, where it can be seen that the flat surface 289 of the lockout member 280 faces toward the release member 180, and permits enough rightward movement of the release member 180 so that the combination of the locking mechanism 100 can be modified or completely changed. In some applications utilizing the locking mechanism 100, it is desired that the locking mechanism 100 be provided with the lockout member 280 so that once a desired combination that opens the lockout mechanism 100 has been set, the lockout member 280 can be turned by the tool 290 to prevent the combination from being accidentally or purposefully changed.

In other applications utilizing the locking mechanism 100, it is desired that the combination that opens the locking mechanism 100 be readily changeable any time that the locking mechanism 100 is unlocked. Where this arrangement is desired, the locking mechanism 100 is best not provided with the optional lockout member 280.

How the combination of locks embodying the present invention can be changed or reset is also described in the seven Combination Changing Patents referenced at the conclusion of the Background section presented above.

Figure 22:
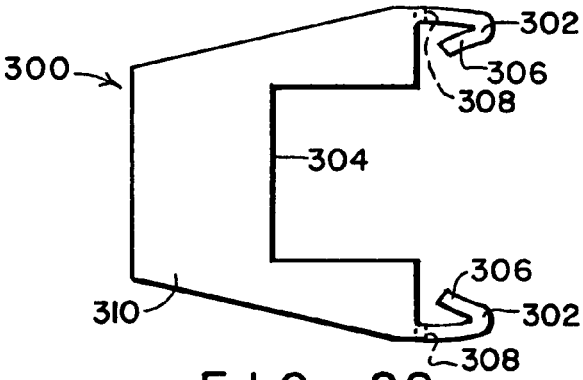
FIG. 22 is a top view, on an enlarged scale, showing one of the optional, generally trapezoidal shaped seals.
Figure 23:
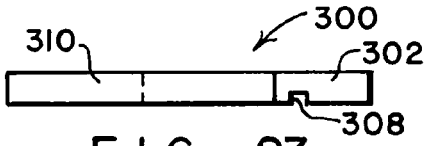
FIG. 23 is a front side view thereof, showing one of the notches that are provided in each of the thin, spaced leg portions of the seal to weaken the leg portions so they will break when the seal is removed after being installed on or connected to the housing of the locking mechanism.

Referring to FIGS. 22 and 23, an optional seal 300 may be provided for installation on or connection to the housing 110 of the locking mechanism 100. Although the seal 300 is complexly configured having two small and spaced-apart legs 302 located on opposite sides of a U-shaped centrally-located notch 304 in a main body portion 310, the perimeter of the seal 300 has something of a trapezoidal shape—hence the seal 300 is referred to herein as having a largely a trapezoidal shape. The small, thin legs 302 are somewhat resilient, each featuring a normally open-V-shape; however, end regions 306 (see FIG. 22) of the legs 302 can be compressed away from each other to close the open-V-shapes, whereafter the elastic memories of the open-V-shapes return the end regions 306 toward each other, so the legs 302 resume their open-V configurations.

Figure 21:
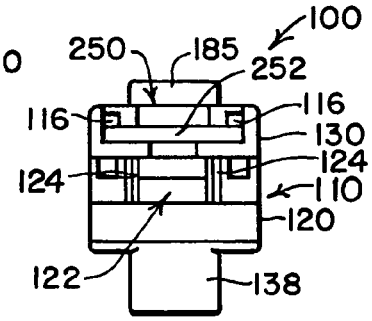
FIG. 21 is a left end view of the lock mechanism with no optional seal installed thereon, therefore permitting a pair of small, spaced, generally rectangular shaped housing openings to be seen that are engaged by thin normally V-shaped legs of a seal during installation of one of the optional seals onto the housing of the locking mechanism.

Referring to the left end view of the housing 100 that is provided by FIG. 21, the upper housing portion 120 has a pair of small, spaced, identical, generally rectangular openings 116 (also visible in FIG. 3 and some of the cross-sectional views). The openings 116 open into housing-defined passages 119 that extend downwardly through the upper and lower housing components 130, 120, respectively, and can be seen in FIG. 34 to open through bottom surface areas of the lower housing component 120.

Figure 18:
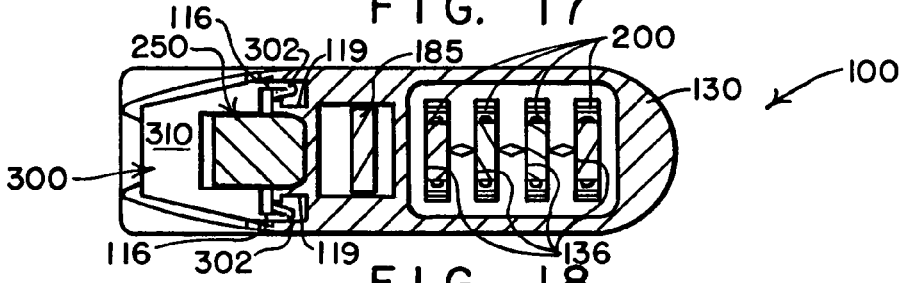
FIG. 18 is a cross-sectional view thereof, as seen from a plane indicated by a line 18-18 in FIG. 17, with this view showing how the thin, normally V-shaped legs of the seal are compressed during insertion thereof into small, generally rectangular shaped housing openings that are shown best in FIG. 21.

The small openings 116 are sized so that, as the open-V-shaped legs 302 of a seal 300 are inserted therethrough, the normal open-V-shaped configurations of the legs 302 are compressed to move inner portions 306 of the legs 302 away from each other, thereby temporarily closing the open-V-shapes of the legs 302. Such compression of the normally open-V shape of the legs 302 is at least partially shown in FIG. 18, where it can be seen that, as the legs 302 are inserted through the openings 116, the legs 302 are compressed during installation of a seal 300 on, or connection of a seal 300 to, the housing 110 of the locking mechanism 100.

Figure 17:
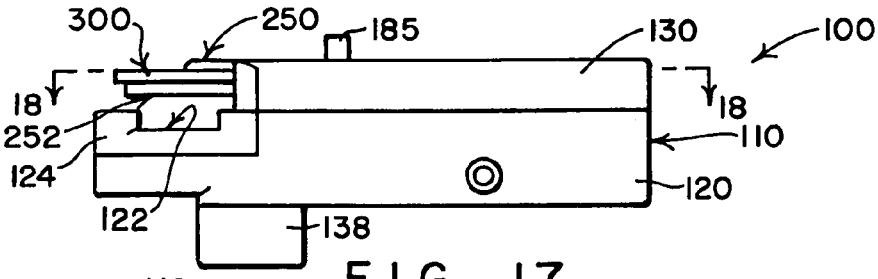
FIG. 17 is a front side view similar to FIG. 5 of the locked locking mechanism, but with the optional seal only partially installed on the housing.
Figure 19:
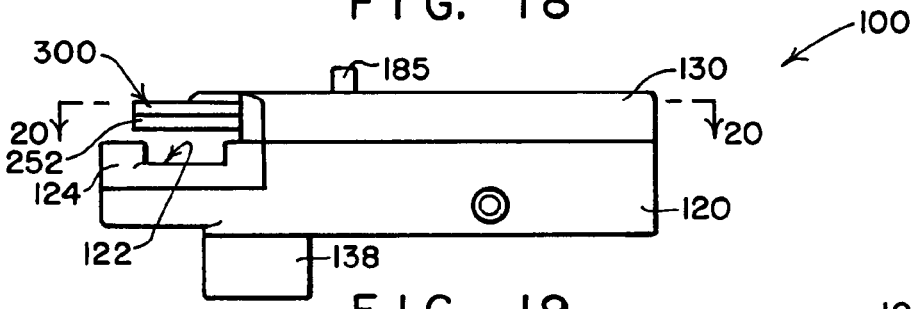
FIG. 19 is a front side view similar to FIG. 5, showing the seal fully installed on the housing of the locking mechanism.
Figure 20:
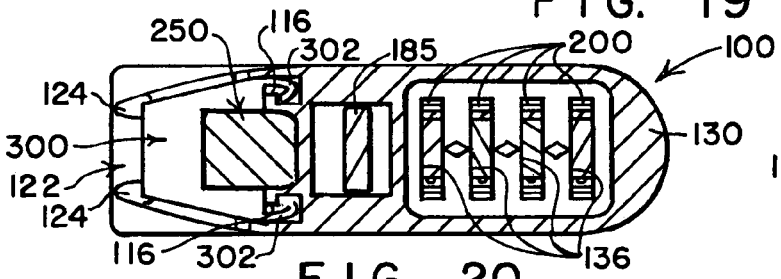
FIG. 20 is a cross-sectional view as seen from a plane indicated by a line 20-20 in FIG. 19.

FIG. 17 also shows the seal 300 in a partially installed attitude. Installation of the seal 300 on the housing 110 is completed by further pressing the seal 300 farther rightwardly to the fully installed position shown in FIGS. 19 and 20. When the seal 300 is fully installed on, or properly connected, to the housing 110, the normally open-V shape of the legs 302 resumes, as is shown in FIG. 20, as the "memory" of legs 302 causes the legs 302 to expand into the downwardly opening passages 119 defined by the housing 119.

Figure 24:
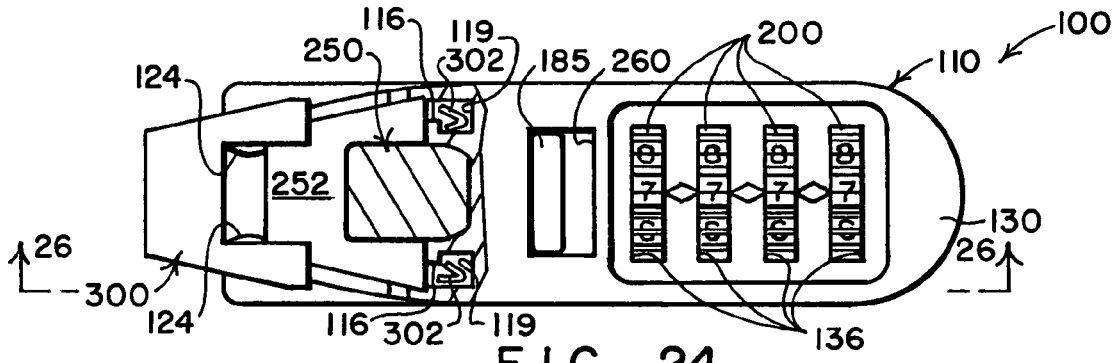
FIG. 24 is top view similar to FIG. 12 but showing a seal being removed from installation on or connection to the housing of the locking mechanism, with the view showing portions of the locking mechanism broken away and shown in cross-section so broken off portions of the thin, normally V-shaped legs of the seal can be seen within or dropping beneath passages of the housing that open downwardly to direct the broken-off seal leg portion into a security container connected to the locking mechanism, portions of which are depicted in FIGS. 1 and 2.
Figure 25:
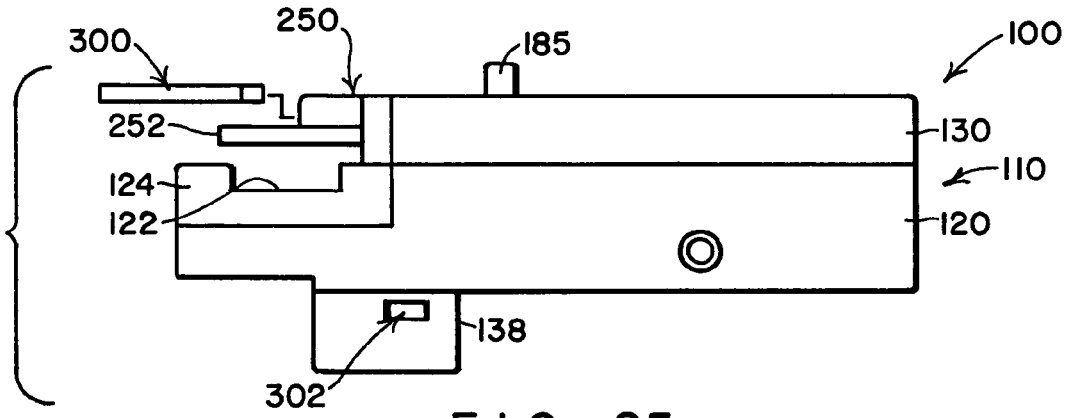
FIG. 25 is a front side view of the locked locking mechanism similar to FIGS. 5 and 19, but showing a seal being removed from the housing thereof, and showing how one broken-off leg portion of the seal drops out of the bottom of the housing.
Figure 26:
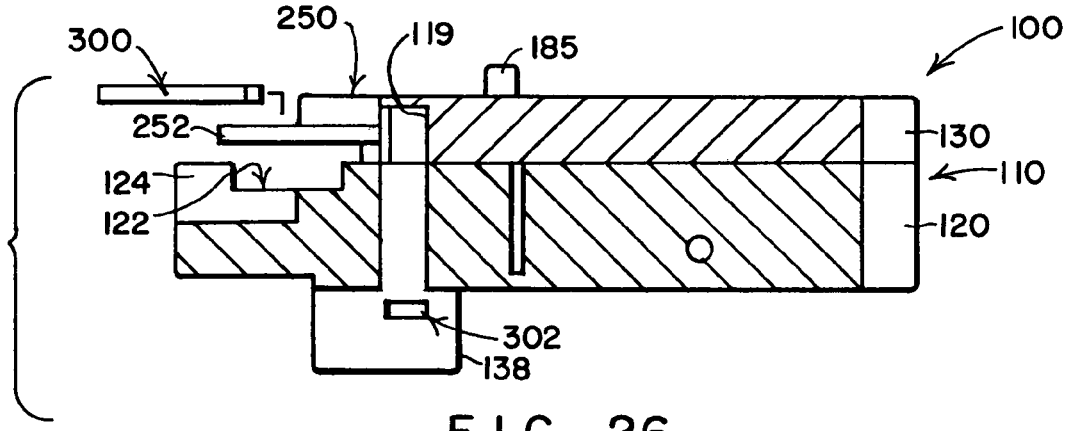
FIG. 26 is a cross-sectional view thereof, as seen from a plane indicated generally by a line 26-26 in FIG. 24, again showing how the broken-off leg portions of the seal drops out of the bottom of the housing of the locking mechanism during removal of a broken seal from being installed on or connected to the housing of the locking mechanism.
Figure 27:
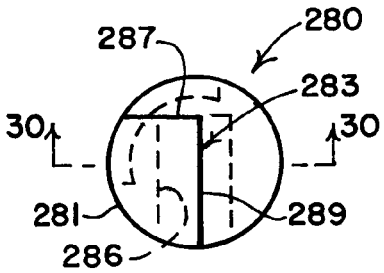
FIG. 27 is a top view, on an enlarged scale, of a turnable lockout member that can be provided in the locking mechanism to selectively permit and prevent modification of a proper combination that, when set, unlocks the locking mechanism.
Figure 28:
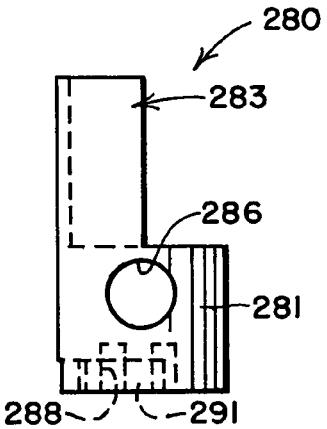
FIG. 28 is a front view thereof, with the view showing 1) that an upper portion of the lockout member is provided with a right angle formation (that also has various surfaces more completely depicted in FIGS. 28 and 29, taken together), 2) that a central portion of the lockout member is provided with a horizontal opening (for carrying a spring and ball detent depicted in FIG. 3), and 3) that a bottom portion of the lockout member has formations which are more completely illustrated in the bottom view provided by FIG. 31.
Figure 29:
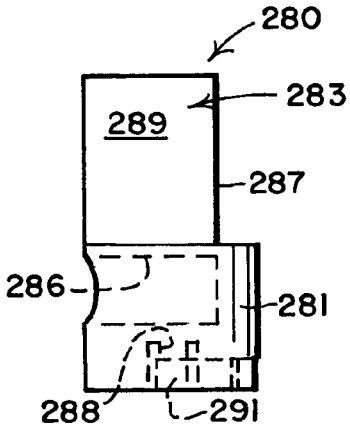
FIG. 29 is a right side view thereof.
Figure 30:
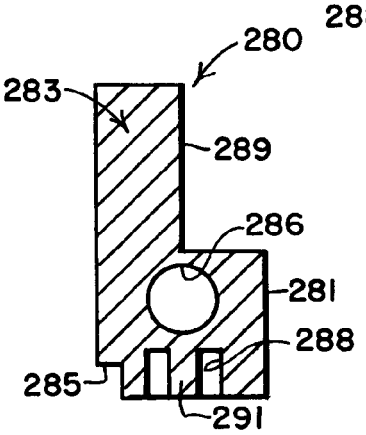
FIG. 30 us a cross-sectional view thereof, as seen from a plane indicated by a line 30-30 in FIG. 27.

If an installed or properly connected seal 300 is pulled off or otherwise removed from the housing 110 as is illustrated in FIGS. 24-26, the main body portion 310 of the seal 300 separates from the legs 302. Broken off leg portions 302 then fall through downwardly through the housing-defined passages 119 (as shown in FIGS. 24-26, and out the bottom portion of the housing 110, for discharge into the interior of the security container 50.

A feature of the identical legs 302 of each seal 300 is the provision of a groove 308 (one of which is depicted by solid lines FIG. 23, both of which are shown by hidden lines in FIG. 22) that purposefully weaken the legs 302 near where the legs 302 join the main body portion 310 of the associated seal 300. The one-piece construction of the optional seal 300 is intended to permit seals 300 to be installed one at a time on, or connected one at a time to, the left end region of the upper housing portion 130 in a manner that positively obstructs any attempt to upwardly move the spring-projected bolt 250 unless and until the installed or connected seal 300 is broken and removed from the housing 110, causing the broken-off legs 302 to be retained in and to drop downwardly through the housing-defined passages 119 and out the bottom of the housing 110.

A feature that preferably characterizes each of the seals 300 (rendering each seal 300 unique) is that each seal preferably includes some unique number or other unique identifier (not shown) that is difficult to predict, so that a seal 300 that is installed on or connected to the housing 100 cannot be easily duplicated and replaced. By this arrangement, once a locked security container 50 has its locking mechanism 100 provided with a seal 300 installed on or connected to the housing 110, the container 50 can be transported from one location to another without fear that its locking mechanism 100 can be opened without readily disclosing this fact, due to a missing or obviously replaced seal.

In practice, a unique number or other identifier typically is placed somewhere on a surface of the main body portion 310 of the seal 300 (FIGS. 22, 23) where the number or other identifier cannot be seen when the seal 300 is installed on the housing 110, and so that the seal 300 cannot be pried away from the locking mechanism 100 to view the number or other identifier without causing breakage of the weakened legs 302 of the seal 300 (e.g., on a surface of the main body portion 310 that faces into the U-shaped recess 122).

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended to protect whatever features of patentable novelty that exist in the invention disclosed.

What is claimed is:

1. A combination operated lock having a housing connectable to a flexible fabric security bag having a zippered closure that permits valuables to be inserted into and removed from the bag only when the zippered closure is open, and that retains inserted valuables within the bag when the zippered closure is closed, wherein the lock has a lock bolt movable relative to the housing along a path of travel between an unlocked first position extending away from the housing where the housing and the lock bolt can receive a portion of the closed zippered closure therebetween, and a locked second position near the housing where the housing and the lock bolt cooperate to grip and retain the received portion of the closed zippered closure therebetween to prevent the zippered closure from opening until a plurality of dials carried by the housing are turned to set a combination that unlocks the lock to permit movement of the lock bolt along the path of travel toward the unlocked position so the portion of the zippered closure can move from between the housing and the lock bolt to enable the zippered closure to open, and wherein the lock bolt is movable relative to the housing between the unlocked first position and a third position to enable the plurality of dials to be turned to modify the combination that unlocks the lock.

2. A combination lock, comprising:

a) a housing attachable to structure defining a pouch of a security bag near the location of an end region of an elongate pouch opening that provides access to an interior of a pouch defined by the security bag, toward which location a closure member of the security bag can be moved to hold closed the pouch opening, and away from which location the closure member can be moved to provide access through the pouch opening to the interior of the pouch;

b) a locking mechanism carried by the housing and being operable, when locked, to retain the closure member where the closure member holds closed the pouch opening unless and until a predetermined combination is set on the locking mechanism that must be set to unlock the locking mechanism before the closure member can be moved to provide access through the pouch opening to the interior of the pouch; and c) a finger-engageable formation carried by the housing, the finger-engageable formation movable relative to the housing in a direction to unlock the locking mechanism when the locking mechanism is locked, and movable further in the direction when the locking mechanism is unlocked to enable modification of the predetermined combination.

3. The combination lock of claim 2 with the closure member being a component of a zipper having portions that extend along opposed sides of the elongate pouch opening, and with the locking mechanism being configured, when locked, to receive and to retain the zipper component where the closure member holds closed the pouch opening.

4. A combination operated lock connectable to a security pouch capable of carrying valuables within an interior of the security pouch, wherein the security pouch is formed of wear and tear resistant flexible material, and has a zippered closure extending along an opening into the interior of the pouch, with the zippered closure having a graspable tab that is movable between a position where the tab opens the opening, and a position where the tab holds the opening closed, the lock comprising:

a) a locking mechanism having a housing connectable to the flexible material and supporting a lock bolt for movement along a path of travel between a locked first position near the housing for clamping and retaining the graspable tab in the closed position, and an unlocked second position extending away from the housing to release the graspable tab for movement toward and away from the closed position so the pouch can be zippered to the open position; and b) the locking mechanism further includes structure enabling a predetermined combination to be set as must be done before the lock bolt can be moved to the unlocked second position, and when not set, prevents movement of the lock bolt out of the locked first position, wherein the housing supports the lock bolt for movement between the unlocked second position and a third position to enable the predetermined combination to be modified.

5. The combination operated lock of claim 4 wherein the structure enabling a predetermined combination to be set includes a plurality of dials carried by the housing that must be turned to set the predetermined combination and that must be turned when the lock bolt is moved to the third position to modify the predetermined combination.

6. A combination controlled lock for a security pouch formed of wear and tear resistant flexible material, and having an elongate zippered closure extending along an elongate opening into the interior of the pouch, and having a graspable tab movable along the zippered closure between open positions of the opening, and a closed position of the opening where the tab is located near a selected one of the end regions, the combination lock comprising:

a) a locking mechanism having a housing suited for attachment to the flexible material of the security pouch near the selected one of the end regions, and having a lock bolt for moveable along a path of travel between a locked first position enabling the lock bolt and the housing to cooperate to retain the graspable tab in the closed position, and an unlocked second position that permits the graspable tab to move toward and away from the closed position so the pouch can be zippered open; and b) with the locking mechanism further including a plurality of dials movably connected to the housing that are rotatable to set elements of a predetermined combination that must be set to permit movement of the lock bolt to the unlocked second position, and when not set, prevents movement of the lock bolt out of the locked first position, the plurality of dials also rotatable to modify elements of the predetermined combination when the lock bolt is moved from the unlocked second position to a third position.

7. A combination lock attachable to a security bag, and being operable, when attached to the security bag, to obstruct access to an interior portion of the security bag unless a predetermined combination is set on the combination lock, the combination lock comprising:

a) a lock bolt movable along a path of travel between an unlocked first Position to enable access to the interior portion of the security bag when the predetermined combination is set, a locked second position to obstruct access to the interior portion of the security ban when the predetermined combination is not set, and a third position to enable the predetermined combination to be modified; and b) a finger-engageable formation movable in a direction relative to the path of travel to enable the lock bolt to move toward the unlocked first position from the locked second position when the predetermined combination is set, and movable further in the direction when the lock bolt is in the unlocked first position to enable modification of the predetermined combination, wherein movement of the bolt towards the third position causes the finger-engageable formation to move further in the direction.

8. The combination operated lock of claim 1, wherein the lock bolt is movable from the unlocked first position to the third position by tilting the lock bolt out of the path of travel.

9. The combination operated lock of claim 8, wherein the plurality of dials turn about an axis that extends perpendicular to the path of travel of the lock bolt.

10. The combination operated lock of claim 1, comprising a finger-engageable formation carried by the housing, wherein the lock bolt is biased to move from the locked second position to the unlocked first position, wherein the finger-engageable formation is movable in a direction relative to the housing to enable the lock bolt to move from the locked second position toward the unlocked first position, and wherein movement of the lock bolt to the third position causes further movement of the finger-engageable formation in the direction relative to the housing to enable the plurality of dials to be turned to modify the combination that unlocks the lock.

11. The combination operated lock of claim 1, comprising a lockout member operable by a tool through an opening formed through a bottom portion of the housing between an initial position that prevents modification of the combination and a subsequent position that allows modification of the combination, the bottom portion of the housing to extend into the bag to become accessible only when the zippered closure is open.

12. The combination lock of claim 2, comprising a plurality of dials carried by the housing, the plurality of dials operable to set the predetermined combination on the locking mechanism to unlock the locking mechanism when the locking mechanism is locked, and operable to modify the predetermined combination on the locking mechanism when the locking mechanism is unlocked and the finger-engageable formation moved further in the direction.

13. The combination lock of claim 2, wherein the locking mechanism comprises a lock bolt movable relative to the housing along a path of travel between an unlocked first position extending away from the housing when the locking mechanism is unlocked to allow the closure member to be moved to provide access through the pouch opening to the interior of the pouch, and a locked second position near the housing when the locking mechanism is locked to cooperate with the housing to retain the closure member where the closure member holds closed the pouch opening.

14. The combination lock of claim 13, wherein the lock bolt is movable from the unlocked first position to a third position by tilting the lock bolt out of the path of travel to cause the further movement of the finger-engageable formation in the direction relative to the housing to enable modification of the predetermined combination.

15. The combination operated lock of claim 4, wherein the housing supports the lock bolt in a manner that enables tilting of the lock bolt out of the path of travel from the unlocked second position to the third position.

16. The combination operated lock of claim 4, comprising a finger-engageable formation carried by the housing, wherein the lock bolt is biased to move from the locked first position to the unlocked second position, wherein the finger-engageable formation is movable in a direction relative to the housing to enable the lock bolt to move from the locked first position toward the unlocked second position, and wherein movement of the lock bolt to the third position causes further movement of the finger-engageable formation in the direction relative to the housing to enable the predetermined combination to be modified.

17. The combination controlled lock of claim 6, wherein the lock bolt is movable from the unlocked second position to the other position by tilting the lock bolt out of the path of travel.

18. The combination controlled lock of claim 17, wherein the plurality of dials turn about an axis that extends perpendicular to the path of travel of the lock bolt.

19. The combination controlled lock of claim 6, comprising a finger-engageable formation carried by the housing, wherein the lock bolt is biased to move from the locked first position to the unlocked second position, wherein the finger-engageable formation is movable in a direction relative to the housing to enable the lock bolt to move from the locked first position toward the unlocked second position, and wherein movement of the lock bolt to the third position causes further movement of the finger-engageable formation in the direction relative to the housing to enable the plurality of dials to be turned to modify elements of the predetermined combination.

20. The combination controlled lock of claim 6, comprising a lockout member operable by a tool through an opening formed through a bottom portion of the housing between an initial position that prevents modification of elements of the predetermined combination and a subsequent position that allows modification of elements of the predetermined combination, the bottom portion of the housing to extend into the security pouch to become accessible only when the security pouch is zippered open.

21. The combination lock of claim 7, comprising a plurality of dials that turn about an axis that extends perpendicular to the path of travel, the plurality of dials operable to set the predetermined combination to enable the movement of the finger-engageable formation in the direction to enable the lock bolt to move toward the unlocked first position, and operable to modify the predetermined combination when the finger-engageable formation is further moved in the direction to enable modification of the predetermined combination.

* * * * *